US005810221A

United States Patent [19]

Beletsky et al.

[11] Patent Number: 5,810,221

[45] Date of Patent: Sep. 22, 1998

[54] HANDGUN HOLSTER HAVING A TRIGGER GUARD RETAINER LATCH

[75] Inventors: Robert J. Beletsky; Anthony G. Lefeber, both of Temecula, Calif.

[73] Assignee: Bianchi International, Temecula, Calif.

[21] Appl. No.: 786,554

[22] Filed: Jan. 21, 1997

[51] Int. Cl.[6] ..... F41C 33/02

[52] U.S. Cl. ..... 224/244; 224/911

[58] Field of Search ..... 224/242, 243, 224/244, 911, 912

[56] References Cited

U.S. PATENT DOCUMENTS

| | | | |
|---|---|---|---|
| 2,551,913 | 5/1951 | Toby | 224/244 |
| 3,910,469 | 10/1975 | Baldocchi | 224/244 |
| 4,256,243 | 3/1981 | Beletsky et al. | 224/244 |
| 4,277,007 | 7/1981 | Bianchi et al. | 224/244 |
| 4,846,384 | 7/1989 | Perry | 224/244 |
| 4,925,075 | 5/1990 | Rigers | 224/244 |
| 5,018,654 | 5/1991 | Rogers et al. | 224/244 |
| 5,129,562 | 7/1992 | Bianchi | 224/244 |
| 5,161,721 | 11/1992 | Nichols | 224/243 |
| 5,275,317 | 1/1994 | Rogers et al. | 224/244 |
| 5,284,281 | 2/1994 | Nichols | 224/244 |
| 5,395,021 | 3/1995 | Brown | 224/244 |
| 5,467,909 | 11/1995 | Resca et al. | 224/244 |
| 5,518,155 | 5/1996 | Gallagher | 224/244 |
| 5,573,157 | 11/1996 | Mauriello et al. | 224/244 |
| 5,598,958 | 2/1997 | Ryan, III et al. | 224/244 |

*Primary Examiner*—Henry J. Recla
*Assistant Examiner*—Gregory M. Vidovich
*Attorney, Agent, or Firm*—Wagner Middlebrook & Kimbell

[57] ABSTRACT

A holster for a handgun having a trigger guard is formed of material such as leather or the like which is folded upon itself to make a pocket with an opening at the top. A pair of openings are located on opposite sides of the pocket adjacent the position of the trigger guard when the handgun is in the pocket. A retainer member of low friction material having resilient arms and clamp members with inwardly extending projections is fastened in the holster such that the arms and clamp members extend through the openings. When the handgun is placed in the holster, the trigger guard pushes past the projections on the clamp members which then latch around the trigger guard securing the handgun in the holster. Various embodiments of trigger guard retainer latch each include a bracket structure which is movable either to a first position where the bracket prevents outward movement of the arms and clamp members to thereby prevent release of the trigger guard or to a second position where the bracket is moved away from the arms and clamp members to permit the trigger guard to be pulled through the clamp members. In two embodiments, the bracket is pivotally moved away from or toward the arms and in other embodiments a slide mechanism is movable to block or to permit movement of the arms and clamp members.

7 Claims, 7 Drawing Sheets

FIG. 1
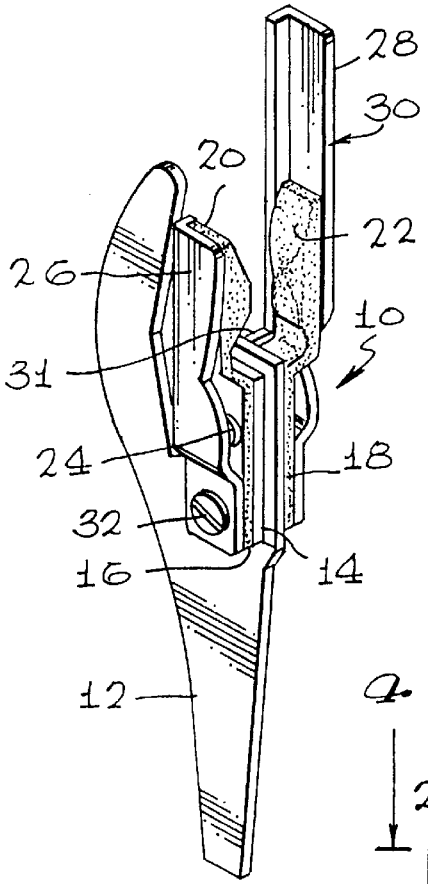
FIG. 2
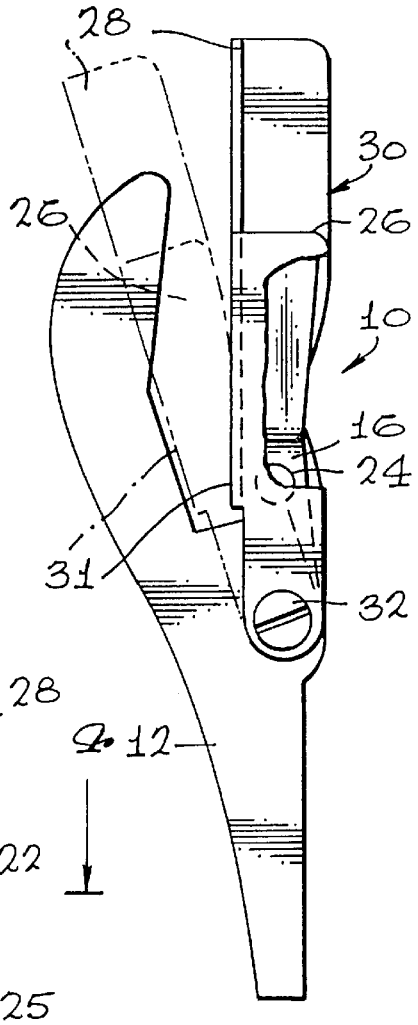
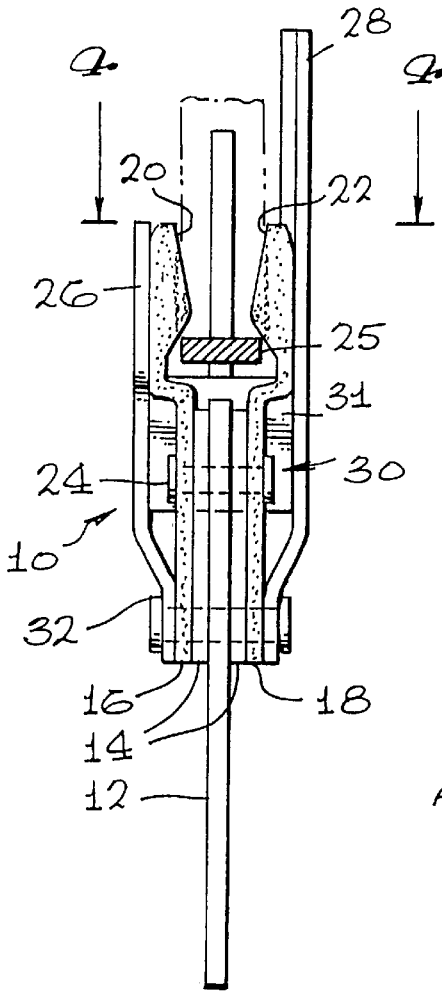
FIG. 3

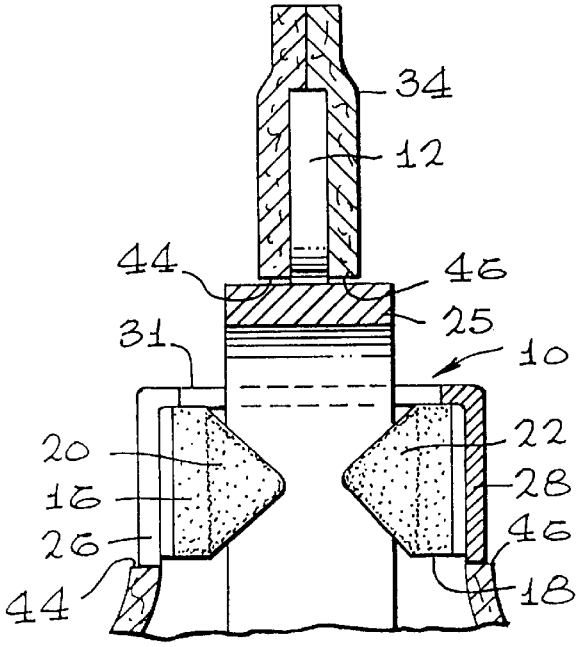
FIG. 4
FIG. 5
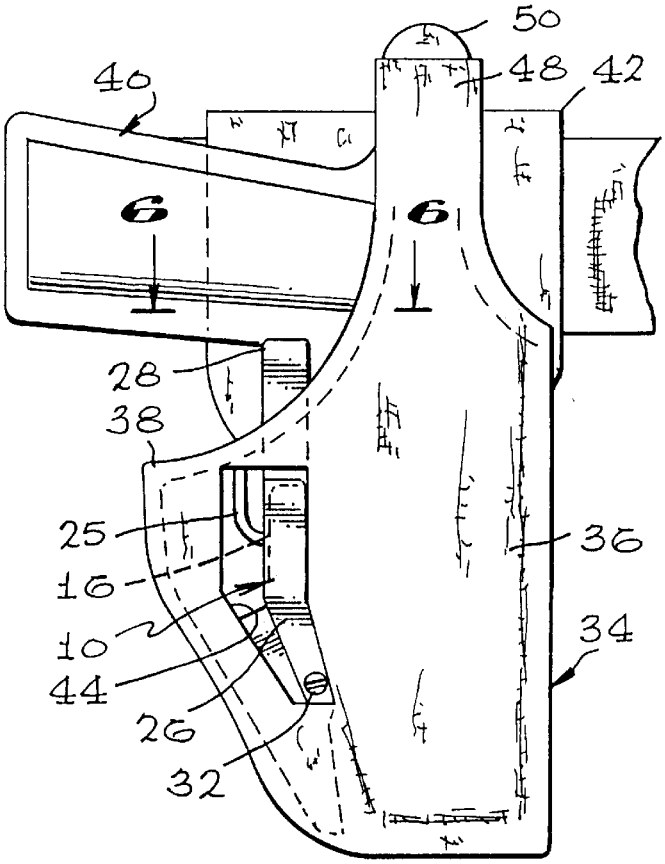

FIG. 6
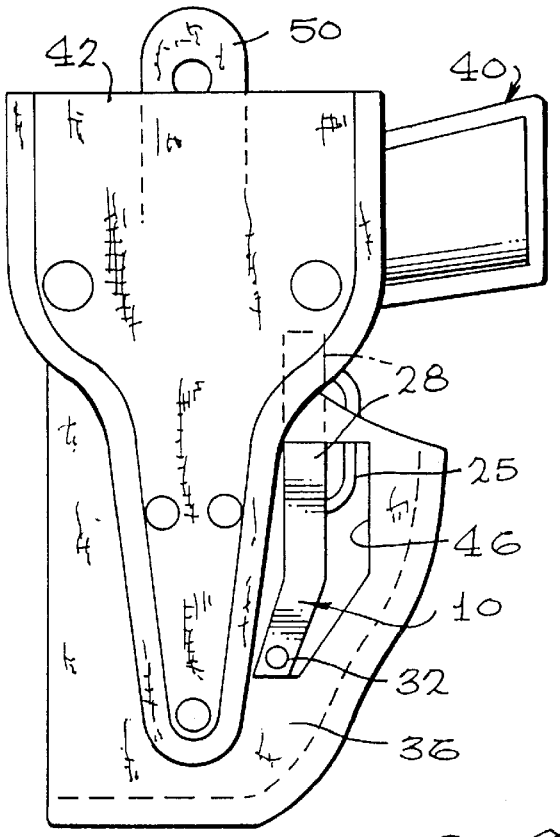
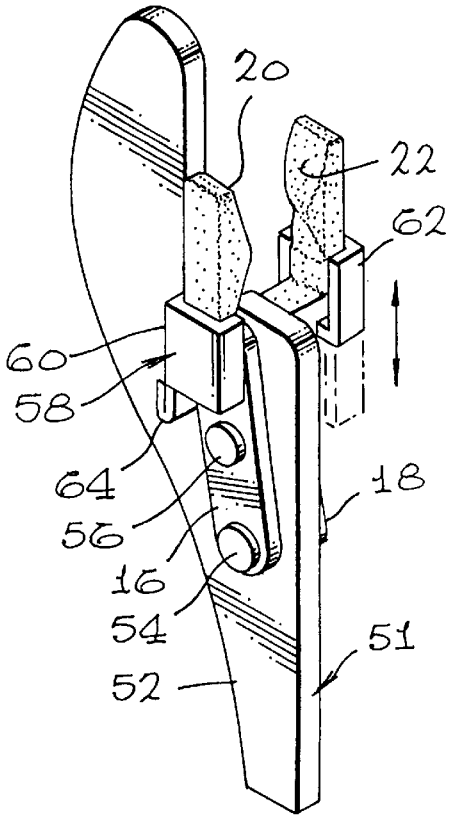
FIG. 7
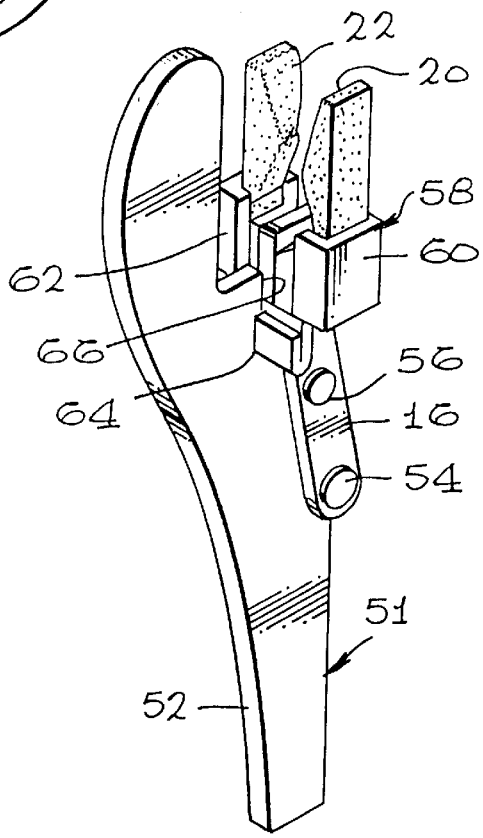
FIG. 8

FIG. 18
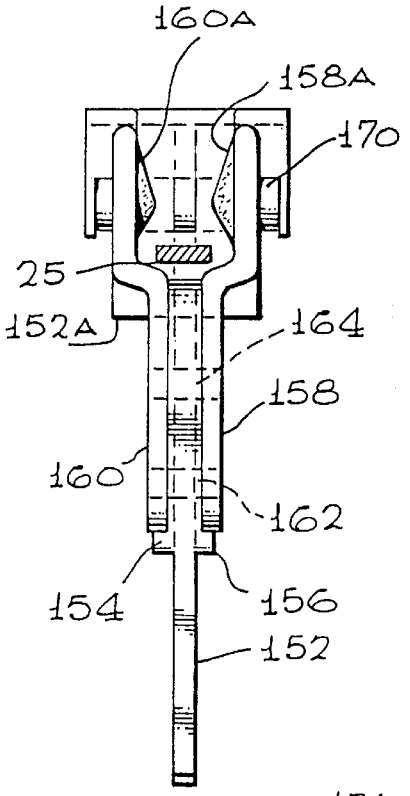
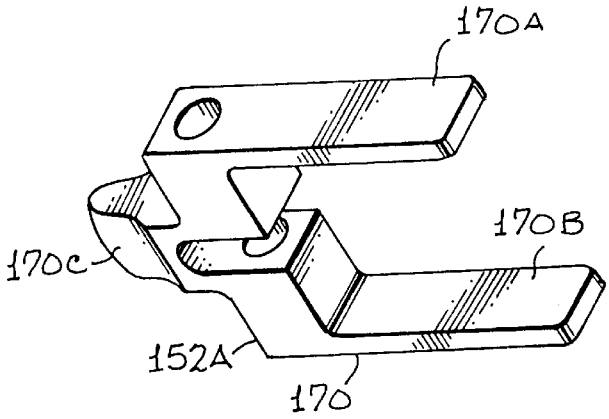
FIG. 19
FIG. 21
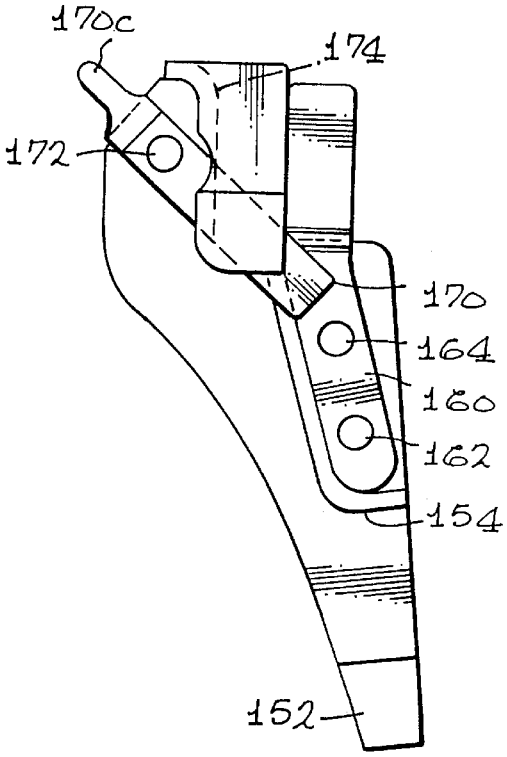
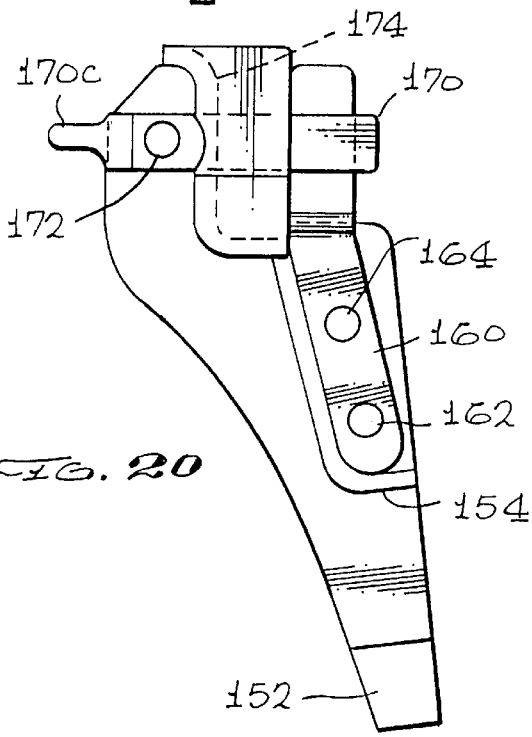
FIG. 20

HANDGUN HOLSTER HAVING A TRIGGER GUARD RETAINER LATCH

BACKGROUND OF THE INVENTION

This invention relates to holsters for handguns and more particularly to an arrangement for preventing the unintended removal of a handgun from a holster.

There has been a need for a retainer mechanism for both top opening and front opening holsters which will prevent the weapon from becoming dislodged during strenuous activities. In recognition of this need, a holster providing a hesitation lock for use in the opening and top removal holsters was designed by the applicant herein and another which became the subject of U.S. Pat. No. 4,256,253. A somewhat similar requirement in a front opening holster is met and disclosed in Bianchi et al, U.S. Pat. No. 4,277,007. A pistol retaining device is shown in U.S. Pat. No. 5,129,562. In this patent, a retainer mechanism is disclosed which includes somewhat resilient outwardly extending arms to which are attached inwardly extending projections. These projections have tapered surfaces which are contacted by the trigger guard of the handgun when it is placed in the holster and caused to spread and then snap together behind the trigger guard to hold the handgun in position. When it is desired to remove the handgun, only a limited force is required of the user to deflect the arms and, hence, the projections, to pull the trigger guard through the projections and draw the handgun.

While the arrangements described in the above patents are adequate to protect a handgun during strenuous action of the wearer, further protection is desired.

BRIEF DESCRIPTION OF THE INVENTION

In order for the officer to have a more positive lock for the pistol retaining device, applicants have provided a latch including a bracket mechanism which is operable by the wearer of the holster to be movable from a first position where the bracket effectively prevents spreading of the arms of the retainer mechanism and thereby secures the handgun in the holster and a second position where the bracket is displaced from the retainer mechanism permitting normal removal of the handgun.

The latch is secured in the holster along with the retainer mechanism and, in one embodiment, is secured to one of the same fasteners holding the retainer mechanism together. With this and a similar embodiment, the bracket pivots from a first position where it surrounds or captures the arms and projections to thereby prevent them from being moved outwardly, to a second position where the bracket clears the arms permitting the trigger guard to be pulled through the projections and the handgun to be withdrawn in a normal fashion.

In other embodiments, the bracket is part of a slide mechanism which in one position inhibits outward movement of the arms of the retainer and which may be readily moved by the wearer to a second position permitting normal removal of the handgun.

BRIEF DESCRIPTION OF THE DRAWINGS

This invention may be more clearly understood with the following detailed description and by reference to the drawings in which:

FIG. 1 is a perspective view, partly in section, of the combined pistol retaining device and bracket mechanism forming a part of the holster according to the invention;

FIG. 2 is a side view of the combined retainer and bracket mechanism of FIG. 1 with the bracket shown in locked and in phantom unlocked position;

FIG. 3 is a top plan view of the retainer and latch mechanism of FIGS. 1 and 2;

FIG. 4 is a sectional view of the retainer and bracket mechanism of FIG. 3 taken along line 4—4 of FIG. 3;

FIG. 5 is an outer side elevational view of a top opening and top removal holster incorporating my invention with a handgun secured therein;

FIG. 6 is a view from the inner side of the holster and handgun of FIG. 5;

FIG. 7 is a top right perspective view of an alternate retainer and latch mechanism which may be built into the holster of FIG. 3;

FIG. 8 is a perspective view of the retainer and latch mechanism of FIG. 7 seen from below;

FIG. 18 is a side plan view of the handgun retaining device and bracket mechanism of FIG. 17 with the resilient arms included;

FIG. 19 is a perspective view of the bracket forming part of the device of FIGS. 17 and 18;

FIG. 20 is a side elevational view of the handgun retaining device and bracket mechanism of FIGS. 17 and 18 showing the bracket in position to prevent removal of a handgun from the associated holster;

FIG. 21 is side elevational view similar to FIG. 20 except that the bracket has been moved to a position permitting removal of a handgun from the associated holster.

DETAILED DESCRIPTION OF THE INVENTION

Figure 9:
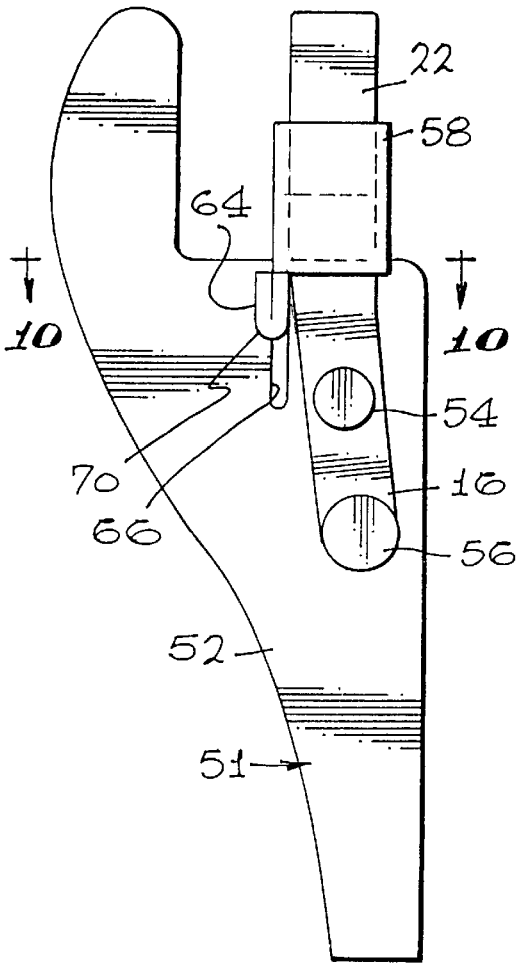
FIG. 9 is a side elevational view of the retainer and latch mechanism of FIGS. 7 and 8.

Now referring to the drawing FIGS. 1–5 in which FIG. 1 is a perspective view of the combined pistol retaining device and latch or bracket mechanism 10 forming a key part of the holster of the invention. Support 12 is, preferably, a plastic part which is stitched, riveted or otherwise secured within a holster. Adjacent to support 12 are a pair of spacers 14 and next to the spacers a pair of upstanding somewhat resilient arms 16 and 18 of the pistol retaining device of the type illustrated in U.S. Pat. No. 5,129,562. At the opposite ends of arms 16 and 18 which are slightly flared outwardly are a pair of inwardly extending projections 20 and 22. Members 12, 14, 16 and 18 are held together in part by means of a fastener 24 such as a rivet. The arms 16 and 18 have sufficient resistance to bending to prevent the weight of the handgun from deflecting the arms and permitting the trigger guard to pass through the arms when the holster is inverted.

Positioned outwardly of resilient arms 16 and 18 are latching arms 26 and 28 of a bracket 30 which includes a cross piece 31 best seen in FIG. 3 to which latching arms 26 and 28 are attached. Arm 28 is extended to provide a manually operated lever. All of members 12 and 14, resilient arms 16 and 18 and latching arms 26 and 28 are pinned together by means of a fastener 32, but since latching arms 26 and 28 are secured only by fastener 32 and not by fastener 24, they are free to pivot around fastener 32.

In the side elevational view of the combined retainer and bracket assembly 10 of FIG. 2, support 12 to which are fastened resilient arms 16 and 18 and latching arms 26 and 28 is visible. Latching arms 26 and 28 are shown in solid lines in a position where they are adjacent resilient arm 16 (and arm 18 not visible in this view), preventing resilient arms 16 and 18 from moving laterally as is necessary to release the trigger guard of a handgun in the holster. Arms 26 and 28 and cross piece 31 are also shown in dotted outline where they are pivoted to the left and downwardly in the drawing FIG. 2 around fastener 32 to a position where they do not inhibit movement of arm 16 (or arm 18) permitting arms 16 and 18 to spread outwardly to permit a trigger guard to pass between inwardly extending projections 20 and 22.

In FIG. 3, the resilient arms 16 and 18 with their inwardly extending projections 20 and 22 are confined by the latching arms 26 and 28. In this position, arms 16 and 18 cannot spread laterally to permit removal of a trigger guard 25. It is believed clear from this view that as latching arms 26 and 28 are rotated around fastener 32, they move away from resilient arms 16 and 18 thereby permitting arms 16 and 18 to spread laterally for normal release of the trigger guard 25.

FIG. 4 is an enlarged sectional view taken along line 4—4 of FIG. 3 including fragmentary portions of a holster 34. In this view the trigger guard 25 is shown in front of the inwardly projecting projections 20 and 22 of resilient arms 16 and 18 in restrained position. Arms 26 and 28 are shown adjacent resilient arms 16 and 18 so that they cannot move outwardly to permit the trigger guard 25 to pass through projections 20 and 22, i.e., toward the viewer of FIG. 4.

FIG. 5 is a plan view, partly in phantom of a top opening and top removable holster 34 incorporating my invention with a handgun 40 secured therein. Holster 34 includes a body 36 which may be of leather or of a composite fabric/foam/fabric material well known in the art. Body 36 is folded at the front, (right side in FIG. 5) and the open edges at the left stitched together to form a pocket having a top opening 38 for inserting and removing of handgun 40. A separate belt loop member 42 is secured to the back side of body 36.

Referring now to both FIG. 5 and to FIG. 6, which is a rear view of the holster of FIG. 5, it will be observed that the outer side of holster 34 has an opening 44 adjacent the trigger guard 25 of handgun 40. Directly opposite opening 44 on the rear side of holster 34 is an opening 46 which is also adjacent trigger guard 25. Visible in openings 44 and 46 are resilient arms 26 and 28 which are part of the retainer and bracket assembly 10 of FIGS. 1, 2 and 3. Openings 44 and 46 are sufficiently large to permit resilient arms 26 and 28 to pivot away from arms 16 and 18 and to permit the ends of arms 16 and 18 to move outwardly sufficient to clear the trigger guard 25. Arm 28 extends out of opening 38 such that it can readily be operated by the wearer. The openings 44 and 46 allow a view of the latch mechanism, however, this mechanism may be covered by the outer layer of the holster body 36 for appearance purposes.

Holster 34 is formed with a pair of longitudinal extensions 48, 50 which constitute straps. These straps include snap fastener halves and are dimensioned such that the longer strap 48 may wrap over the chamber end of the handgun 40 and fasten to strap 50 thereby holding the handgun in the holster 36. Arm 28 is usually made longer and stiffer than arm 26 so that the wearer, when he wishes to remove the handgun may, with one hand, release the snap fastener with his thumb, move arm 28, hence bracket member 30, away from arms 16 and 18, while grasping the grip of handgun 40. In many cases, the holster 34 may not include the straps 48, 50 but the above described mechanism will still provide assurance that the handgun 40 will not be removed from the holster until the wearer moves bracket 30 away from arms 16, 18.

Now please refer to FIG. 7 which is a top right perspective view of an alternate latch and bracket mechanism 51 which may be built into the holster of FIGS. 5 and 6. FIG. 8 is a lower right perspective view of the bracket mechanism of FIG. 7. Mechanism 51 differs from the mechanism of FIGS. 1, 2 and 3 in that the structure for preventing the spread of the arms 16 and 18 is a wearer movable slide bracket 58 rather than a pivoted bracket. Certain parts are, or may be, the same and have been given identical numbers. Support 52 which is fastened into the holster by any suitable means such as sewing or riveting, has secured thereto by fasteners 54 and 56 the resilient arms 16 and 18 which include inwardly extending projections 20 and 22. Spacers 14 may or may not be required. Support 52 includes flanged latching members 60 and 62 which are slidable along the resilient offset parts of arms 16 and 18. Matching members 60 and 62 are connected by means of a bridging portion 64.

Referring to FIG. 8, a slot 66 formed in support 52 receives bridging portion 64 and is of such length that flanged members 60 and 62 may slide longitudinally with respect to resilient arms 16 and 18 between the position shown in FIGS. 7 and 8, a position where arms 16 and 18 cannot spread, to a second position (in dotted outline FIG. 7) where the arms 16 and 18 are permitted to spread to release the trigger guard 25.

FIG. 9 is a side elevational view of the latch and bracket mechanism 51. The slide bracket 58 which is shown includes bridging portion 64 which is movable in slot 66 to permit slide bracket 58 to move downwardly clearing arms 16 and 18 sufficiently to permit them to spread.

Figure 10:
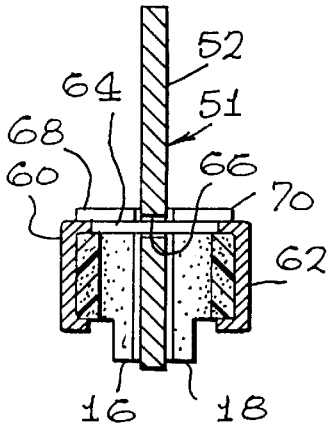
FIG. 10 is a sectional view taken along line 10—10 of FIG. 9.

FIG. 10 is a sectional view taken along line 10—10 of FIG. 9. In this view is shown support 52 to which resilient arms 16 and 18 are attached. The offset parts of arms 16 and 18 are shown in section and flanged members 60 and 62 are shown bracketing arms 16 and 18. Latching members 60 and 62 are connected by bridging portion 64 which includes folded over extensions 68 and 70 which straddle support 52 to keep bracket 58 in proper alignment.

The tolerances of latching members 60 and 62 relative to the offset portions of resilient arms 16 and 18 are such that when members 60 and 62 are in the position to prevent spreading of arms 16 and 18, they have a light friction fit over arms 16 and 18.

Bracket 58 is therefore easily moved downwardly by the forefinger of the wearer to the position where resilient arms 16 and 18 may be forced outwardly as the handgun and trigger guard 25 are pulled upwardly. In the case of a front opening holster, the handgun must initially be moved upwardly to clear the trigger guard past projections 20 and 22 after which the handgun may be moved forwardly to clear the holster.

Figure 11:
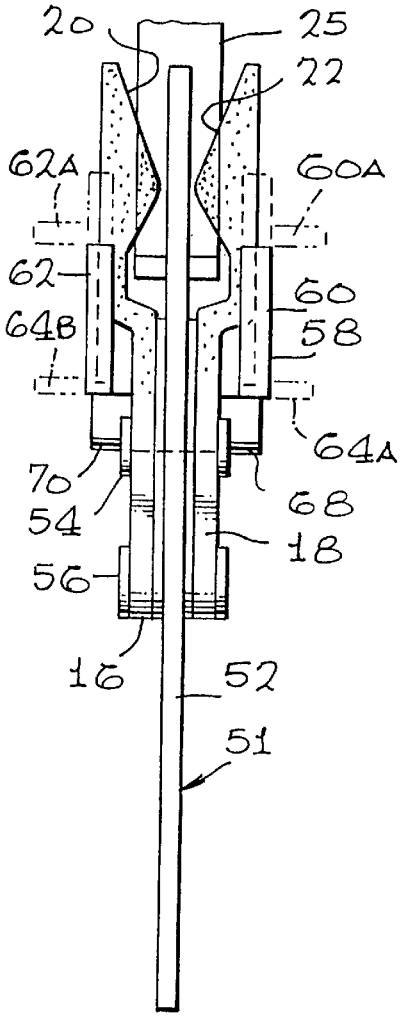
FIG. 11 is a top plan view of the retainer and latch mechanism of FIG. 9.

FIG. 11 is a top plan view of the mechanism 51. In this view it will be seen that latching members 60 and 62 move along the sides of resilient arms 16 and 18 from a position where they do not block outward spreading of arms 16 and 18, shown in solid lines, to a position where they prevent arms 16 and 18 from moving outwardly (dotted outline) thereby preventing trigger guard 25 from moving past projections 20 and 22. Bridging portion 64 or latching members 60 or 62 may include an extension 64A, 64B, 60A, or 62A, shown in phantom which allow the wearer to depress the slide bracket 58 with his thumb or a finger to release or engage the bracket 58.

Figure 12:
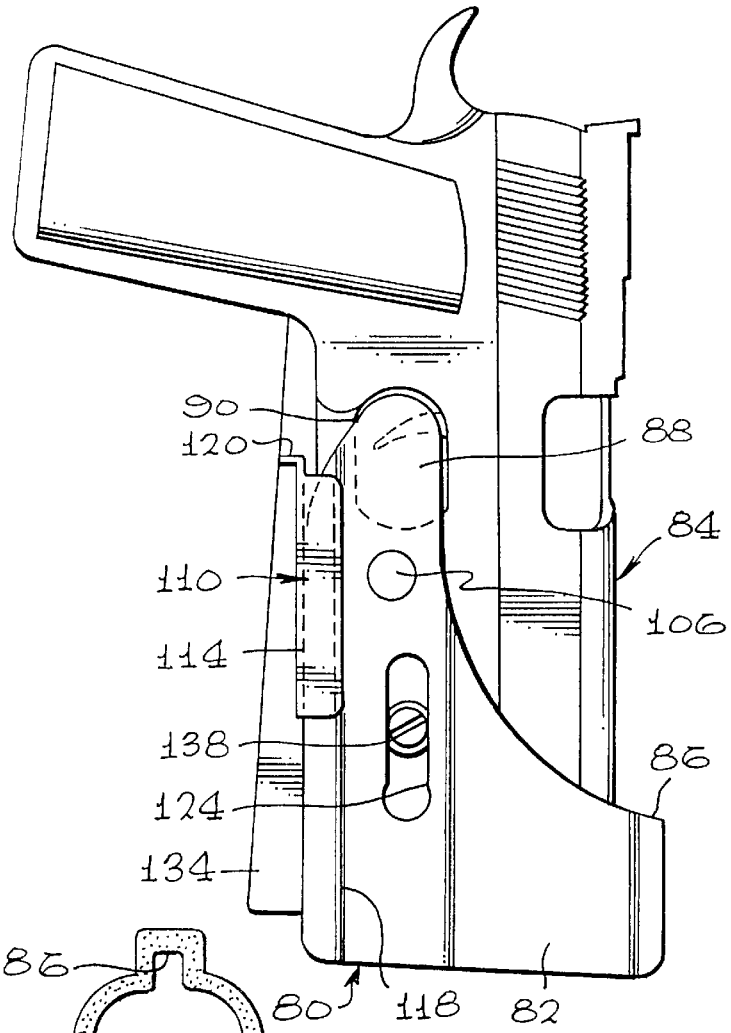
FIG. 12 is an outer side elevational view of a holster of plastic material having a built in retainer and a slide mechanism preventing removal of a handgun from the holster.
Figure 13:
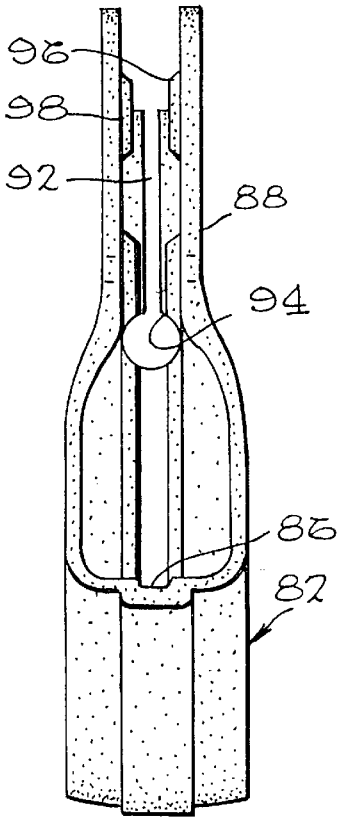
FIG. 13 is a top plan view of the holster of FIG. 12.

FIG. 12 is a front plan view of a holster formed of plastic material having a slide device for preventing removal of a handgun from the holster and showing a handgun in position. This basic holster is very similar to a holster disclosed in U.S. Pat. No. 5,598,958 filed in the names of Willis N. Ryan and Kerby C. Smith. The holster body is shown generally at numeral 80 which is essentially one solid piece of plastic material which might preferably be of molded glass filled nylon. From FIG. 13 which is an end view of holster 80 and top view FIG. 14, it will be seen that body 80 is formed as a closed loop with a wider portion 82 near the top for receiving the barrel and slide of the semiautomatic handgun 84. A groove 86 is formed above the handgun slide barrel location to accommodate its front sight. A narrow portion 88 below the wider portion 82 is sized to receive the trigger guard 90 of the handgun 84. A longitudinal cut 92 in the bottom of holster body 80 extends somewhat less than half the length of body 80 and terminates in a bore 94. Cut 92 and bore 94 make it possible for the sides of narrow portion 88 to be deflected laterally to receive trigger guard 90. A pair of inwardly extending projections 96, 98 serve to capture and hold the trigger guard 90, preventing unintended release of handgun 84.

Figure 16:
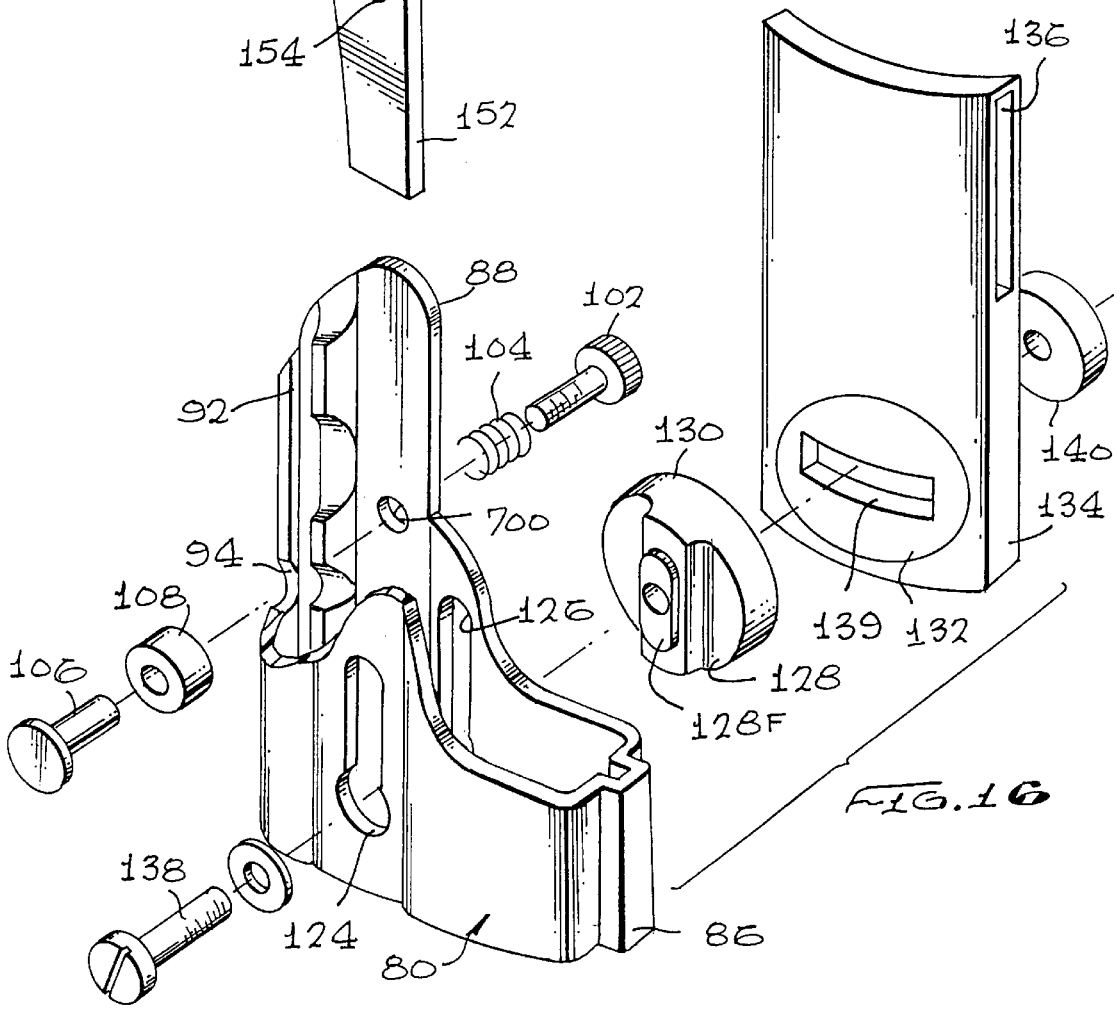
FIG. 16 is an exploded view of the holster of FIG. 12 shown partly broken away.

Referring now to FIG. 16, bore 100 through both sides of narrow portion 88 receives a screw 102 which captures a spring 104 and mates with a female fastener 106 which supports a bushing 108 positioned between the sides of portion 88. Bushing 108 serves as a forward stop for trigger guard 90 when handgun 84 is placed in the holster.

Figure 15:
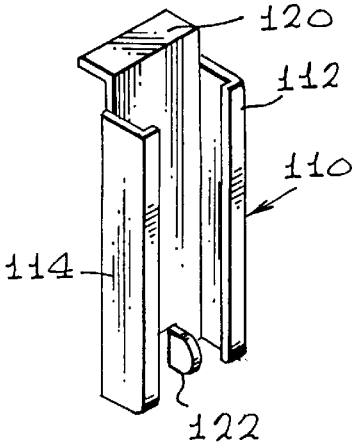
FIG. 15 is a perspective view of the slide member of FIG. 12.

FIG. 15 is a perspective drawing of a slide member 110 which is installed along the bottom of holster body 80 (see FIG. 12) to prevent unintended removal of handgun 84 from body 80. Slide member 110 has two upstanding sides 112, 114 which are curved inwardly at the ends which move along grooves 116, 118 formed in the sides of body 80. At one end of slide member 110, preferably at the top end, a portion is bent downwardly to provide a finger engaging tab 120. At the opposite end of slide member 110 a small upstanding tang 122 is cut and bent upwardly, this tang being movable in longitudinal cut 92 and tending to keep slide member 110 in proper alignment. Tang 122 also acts as a limit stop contacting the side of bore 94 when slide member 110 is moved to its maximum downward position. In this lower or second position, slide member 110 permits the sides of portion 88 to spread, permitting the handgun trigger guard 90 to be pulled past projections 96, 98. When moved upwardly the sides 112, 114 prevent spreading of the sides of portion 88 and removal of the handgun 84 is prevented.

Figure 14:
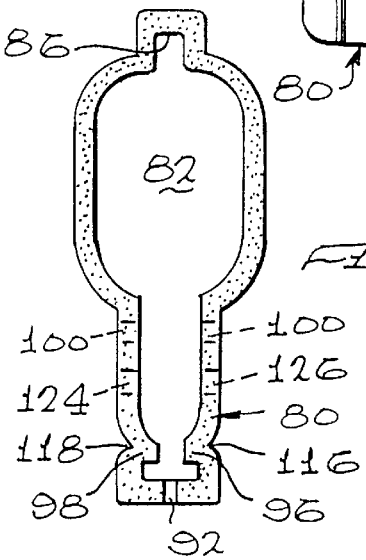
FIG. 14 is a lower end view of the holster of FIG. 12.

Shown in FIG. 16 is an elongated slot 124 in body 80 which is aligned with a similar slot 126 on the opposite side of body 80 (See FIG. 14). Fitting into slot 126 is a flat 128F of a spacer member 128. The opposite end of spacer member 128 consists of a hollow surface with a circular rim 130 which is fitted against a spherical surface 132 of a molded plastic belt loop member 134. A slot 136 in member 134 receives a belt (not shown). A screw 138 passes through body 80, spacer member 128, an elongated slot 139 in belt loop member 134 and a threaded member 140 which has a circular projecting rim and which presses against the back side of spherical surface 132 to secure the entire assembly together. This arrangement permits the wearer to align the holster body 80 at any desired angle with respect to belt loop member 134 simply by loosening screw 138 sufficiently to permit spacer member 128 to be rotated on the spherical surface 132, after which screw 138 is tightened again.

Figure 17:
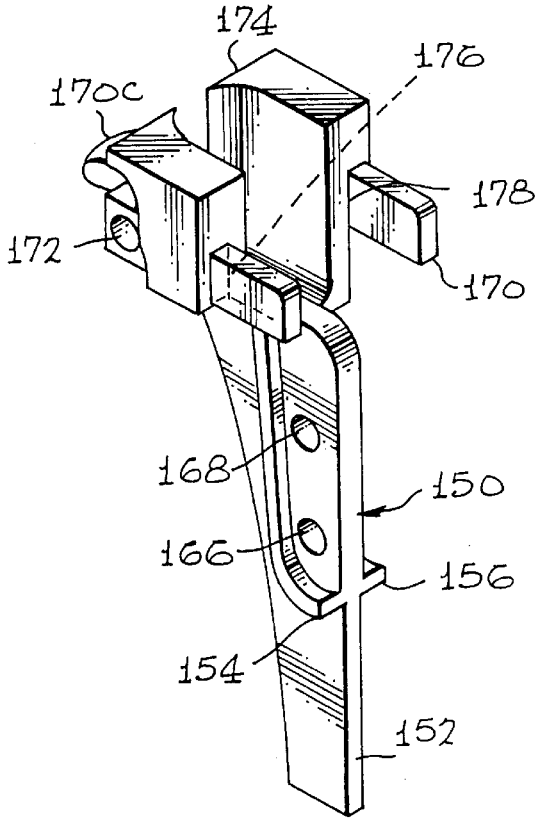
FIG. 17 is a perspective view of an alternative embodiment of a combined handgun retaining device and bracket mechanism forming part of a holster according to the invention with the resilient arms deleted for clarity.

A further alternative embodiment of latch and bracket mechanism for holsters is shown in FIGS. 17–21. This embodiment also includes a pivoted bracket member rather than a slide member as shown in FIGS. 7–16. FIG. 17 is a perspective view of this alternative embodiment (shown without resilient arms for clarity) and includes a latch or bracket mechanism 150 including a support 152, preferably of plastic which is stitched, riveted or otherwise secured in a holster, such as the holster of FIGS. 5 and 6. Molded into the sides of support 152 are a pair of ribs 154 and 156 which serve to support and align a pair of resilient arms 158 and 160 (see top view FIG. 18) attached to support 152 by means of rivets 162 and 164. Rivets 162 and 164 pass through arms 158 and 160 and holes 166 and 168 in support 152.

A bracket 170, shown in perspective in FIG. 19, is pivotally secured to support 152 by means of a pin 172 passing through aligned bores in bracket 170 and support 152. A widened portion 152A of support 150 includes a groove 174 for receiving a handgun trigger guard and a pair of slots 176 and 178 which receive and hold a pair of bracket arms 170A and 170B during such time as it is desired that the handgun remain in the holster. When bracket 170 is in the vertical position shown in FIGS. 17, 18 and 20, it prevents resilient arms 158 and 160 from deflecting or spreading thus preventing the trigger guard 25 from being pulled past inwardly extending projections 158A and 160A (FIG. 18). A finger tab 170C forming part of bracket 170 projects out of support 152 and an opening in the associated holster and is easily accessed by the wearer. FIG. 20, which is a side elevational view of the latch and bracket mechanism shown in FIGS. 17–21, shows bracket 170 in its vertical position (or perpendicular to arms 158 and 160) preventing deflecting of arms 158 and 160.

When it is desired to draw the handgun from the holster, the wearer, in reaching for the handgun, also pulls back on finger tab 170C, rotating bracket 170 around pin 172, as shown on FIG. 21, to a position where arms 170A and 170B are clear of resilient arms 158 and 160, thereby permitting arms 158 and 160 to be deflected or spread outwardly and allowing the trigger guard 25 to be pulled past projections 158A and 160A by the wearer.

The above described embodiments of the present invention are merely descriptive of its principles and are not to be considered limiting. The scope of the present invention instead shall be determined from the scope of the following claims including their equivalents.

What is claimed is:

1. A holster for a handgun including a trigger guard comprising:

a body formed to define a pocket for holding said handgun with an opening for the entrance and exit of the handgun;

a support secured to said body;

a trigger guard retainer including a resilient clamp attached to said support for retaining said trigger guard, said clamp having resistance to bending such that said handgun is prevented from being removed from said holster unless force is supplied sufficient to deflect said clamp and pull said trigger guard past said clamp;

a finger operated latch including a bracket having a pair of spaced clamp adjacent said resilient arms pivotally attached to said support for movement between a first position adjacent said clamp to prevent said clamp from deflecting to prevent removal of said handgun from said pocket and a second position wherein said clamp is permitted to deflect to permit removal of said handgun; and said support including a groove for receiving said trigger guard and slots for receiving and holding said spaced arms when said bracket is in said first position.

2. A holster as claimed in claim 1 wherein said bracket is secured to said support by means of a pivot pin and further includes a finger tab on the opposite side of said pivot pin from said spaced arms for movement of said bracket from said first position to said second position.

3. A holster for a handgun including a trigger guard comprising:

a support secured to said body including a groove for receiving said trigger guard;

a body formed to define a pocket for holding said handgun with an opening for the entrance and exit of the handgun;

a trigger guard retainer secured to said body including a pair of resilient clamp members including a pair of outwardly extending arms having inwardly extending projections secured to said support for retaining said trigger guard, said clamp members having sufficient resistance to bending to prevent the weight of the handgun from deflecting said clamp members and permitting the trigger guard to pass said clamp members when said holster is inverted;

a finger operated bracket attached to said support including a pair of spaced arms adjacent said resilient arms pivotally attached to said support for movement between a first position adjacent said clamp members to prevent said clamp members from deflecting to prevent removal of said handgun from said pocket and a second position wherein said clamp members are permitted to deflect to permit removal of said handgun; and said support further including slots for receiving and holding said spaced arms when said bracket is in said first position.

4. A holster as claimed in claim 3 wherein said body includes at least one opening adjacent said trigger guard, and said bracket is accessible through said opening for manual movement of the bracket by the wearer of the holster from said first position to said second position.

5. A holster as claimed in claim 3 wherein said bracket is secured to said support by means of a pivot pin and further includes a finger tab on the opposite side of said pivot pin from said spaced arms for movement of said bracket from said first position to said second position.

6. A holster for a handgun as claimed in claim 3 wherein a portion of said bracket extends out of said pocket for movement from said first position to said second position by the wearer of said holster.

7. A holster for a handgun including a trigger guard comprising:

a body formed to define a pocket for holding said handgun with an opening for the entrance and exit of the handgun;

a support secured to said body;

a trigger guard retainer including a resilient clamp having a pair of outwardly extending arms having inwardly extending projections attached to said support for retaining said trigger guard, said clamp having resistance to bending such that said handgun is prevented from being removed from said holster unless force is supplied sufficient to deflect said clamp and pull said trigger guard past said clamp;

a latch including a bracket having a pair of spaced arms adjacent said resilient arms pivotally attached to said support for movement between a first position adjacent said clamp to prevent said clamp from deflecting to prevent removal of said handgun from said pocket and a second position wherein said clamp is permitted to deflect to permit removal of said handgun; and said body including at least one opening adjacent said trigger guard, and said bracket is accessible through said opening for manual movement of the bracket by the wearer of the holster from said first position to said second position.

* * * * *